US011136149B2

(12) United States Patent
Que et al.

(10) Patent No.: US 11,136,149 B2
(45) Date of Patent: Oct. 5, 2021

(54) CONTAINER PACKING SYSTEM

(71) Applicant: Futurewei Technologies, Inc., Plano, TX (US)

(72) Inventors: Xiaocun Que, Sunnyvale, CA (US); Jiangsheng Yu, San Jose, CA (US)

(73) Assignee: Futurewei Technologies, Inc., Plano, TX (US)

( * ) Notice: Subject to any disclaimer, the term of this patent is extended or adjusted under 35 U.S.C. 154(b) by 286 days.

(21) Appl. No.: 16/054,551

(22) Filed: Aug. 3, 2018

(65) Prior Publication Data

US 2020/0039668 A1 Feb. 6, 2020

(51) Int. Cl.

| | |
|---|---|
| ***B65B 5/00*** | (2006.01) |
| ***B65B 5/06*** | (2006.01) |
| ***B65B 5/10*** | (2006.01) |

(52) U.S. Cl.

CPC . *B65B 5/06* (2013.01); *B65B 5/10* (2013.01)

(58) Field of Classification Search

CPC .... B65B 5/06; B65B 5/08; B65B 5/10; B65B 2210/04; G06Q 10/04; G06Q 10/08; B65G 1/1378

See application file for complete search history.

(56) References Cited

U.S. PATENT DOCUMENTS

| | | | | |
|---|---|---|---|---|
| 10,287,047 | B2 * | 5/2019 | Zeilstra | B65B 57/18 |
| 10,329,042 | B2 * | 6/2019 | Nammoto | B65B 43/12 |
| 10,669,098 | B1 * | 6/2020 | Terzini | B65G 15/02 |
| 2007/0094101 | A1 * | 4/2007 | Breitling | G06Q 10/08 705/28 |
| 2010/0049537 | A1 * | 2/2010 | Erie | G06Q 10/083 705/1.1 |
| 2013/0186044 | A1 * | 7/2013 | Cremer | B65B 5/10 53/473 |

(Continued)

FOREIGN PATENT DOCUMENTS

| | | | |
|---|---|---|---|
| CN | 101957945 A | * | 1/2011 |
| CN | 101957945 A | | 1/2011 |

(Continued)

OTHER PUBLICATIONS

Lodi, et al., "Heuristic and Metaheuristic Approaches for a Class of Two-Dimensional Bin Packing Problems," Informs Journal on Computing, 11, 1999, 345-357.

(Continued)

*Primary Examiner* — Eyamindae C Jallow
(74) *Attorney, Agent, or Firm* — Conley Rose, P.C.

(57) ABSTRACT

A method for loading boxes in containers is provided. Characteristics of a set of containers having substantially equal dimensions are obtained. Characteristics of a plurality of boxes to be packed into one or more of the set of containers are obtained. A set of layer descriptors is created, each layer descriptor including a layer thickness, identifiers of boxes assigned to the layer, and a description of an arrangement of the boxes in the layer. Each of the boxes is assigned to a single layer descriptor. An optimized assignment of the layer descriptors to containers is determined. An ordered list of box loading instructions for each container is generated. The boxes are loaded in their assigned containers according to the ordered list for the container.

13 Claims, 7 Drawing Sheets

(56) References Cited

U.S. PATENT DOCUMENTS

| | | | | |
|---|---|---|---|---|
| 2014/0123606 | A1* | 5/2014 | Ehrat | B65B 5/105 53/473 |
| 2017/0217620 | A1* | 8/2017 | Zeilstra | G05B 19/402 |
| 2017/0225911 | A1* | 8/2017 | Baechle | B65B 35/24 |
| 2019/0353417 | A1* | 11/2019 | Jalali | B65B 57/12 |

FOREIGN PATENT DOCUMENTS

| | | | |
|---|---|---|---|
| CN | 102214321 | A | 10/2011 |
| CN | 104680237 | A | 6/2015 |
| CN | 105279629 | A | 1/2016 |
| CN | 107352287 | A | 11/2017 |
| CN | 108182552 | A | 6/2018 |
| EP | 2821946 | A1 | 1/2015 |
| JP | 2003007605 | A | 1/2003 |

OTHER PUBLICATIONS

Lodi, et al., "Two-dimensional Packing Problems: A Survey," European Journal of Operational Research, Elsevier Science B.V., 141, 2002, pp. 21-242.

Baltacioglu, The Distributer's Three-Dimensional Pallet-Packing Problem: A Human Intelligence-Based Heuristic Approach, Mar. 2001, 135 pages.

Wu, et al., "Three Dimensional Bin Packing Problem with Variable Bin Height," Elsevier, May 25, 2009, 18 pages.

Machine Translation and Abstract of Chinese Publication No. CN101957945, Jan. 26, 2011, 18 pages.

Machine Translation and Abstract of Chinese Publication No. CN102214321, Oct. 12, 2011, 20 pages.

Machine Translation and Abstract of Chinese Publication No. CN104680237, Jun. 3, 2015, 12 pages.

Machine Translation and Abstract of Chinese Publication No. CN107352287, 19 pages.

Machine Translation and Abstract of Chinese Publication No. CN108182552, Jun. 19, 2018, 24 pages.

Foreign Communication From a Counterpart Application, PCT Application No. PCT/CN2019/098051, English Translation of International Search Report dated Oct. 8, 2019, 5 pages.

Foreign Communication From a Counterpart Application, PCT Application No. PCT/CN2019/098051, English Translation of Written Opinion dated Oct. 8, 2019, 4 pages.

* cited by examiner

CONTAINER PACKING SYSTEM

BACKGROUND

The use of standard-size, multi-modal containers has become common in the transportation industry. As a result, transportation cost is related to the type and number of such containers used for a shipment. The number of containers used for a shipment is directly linked to packing efficiency, or the percentage of container space occupied by the cargo. The higher the packing efficiency, the smaller the number of containers required, resulting in higher efficiency and lower cost in the shipment of cargo.

SUMMARY

In an embodiment, the disclosure includes a method for loading boxes in containers. The method includes obtaining characteristics of a set of containers having substantially equal dimensions; obtaining characteristics of a plurality of boxes to be packed into one or more of the set of containers; creating a set of layer descriptors, each layer descriptor comprising a layer thickness, identifiers of one or more boxes assigned to the layer, and a description of an arrangement of the one or more boxes assigned to the layer, each box in the plurality of boxes being assigned to a single layer description; determining an optimized assignment of the layer descriptors to containers in a subset of the set of containers; and loading the plurality of boxes in each container in the subset according to the optimized assignment of the layer descriptors for the container.

Optionally, in any of the preceding aspects, another implementation of the aspect provides a method wherein creating the set of layer descriptors comprises creating a set of unassigned boxes that includes all the boxes in the plurality of boxes and, while the set of unassigned boxes is non-empty, repeating: creating a set of candidate layer thicknesses (CLTs) having differing thicknesses based on one or more characteristics of the boxes in the set of unassigned boxes; for each CLT in the set of CLTs, determining an optimized single-layer arrangement of one or more boxes from the set of unassigned boxes in the CLT and calculating a packing efficiency for the optimized single-layer arrangement; selecting a CLT having a packing efficiency that is greater than or equal to the packing efficiency of any other CLT in the set of CLTs; adding a layer descriptor to the set of layer descriptors, the layer descriptor comprising a thickness of the selected CLT, identifiers of the one or more boxes in the optimized single-layer arrangement for the selected CLT, and a location and orientation of each box in the optimized single-layer arrangement for the selected CLT; and removing from the set of unassigned boxes the one or more boxes in the optimized single-layer arrangement for the selected CLT.

Optionally, in any of the preceding aspects, another implementation of the aspect provides determining the optimized single-layer arrangement of one or more boxes in the set of unassigned boxes in the CLT is based on one or more basic constraints. Optionally, in any of the preceding aspects, another implementation of the aspect provides determining the optimized single-layer arrangement of one or more boxes in the set of unassigned boxes in the CLT is further based on one or more practical constraints relating to the boxes in the plurality of boxes. Optionally, in any of the preceding aspects, another implementation of the aspect provides determining the optimized assignment of the layer descriptions to the one or more containers is based on one or more practical constraints relating to the containers in the set of containers.

Optionally, in any of the preceding aspects, another implementation of the aspect provides performing creating the set of layer descriptors and determining the optimized assignment of the layer descriptors for layers oriented along at least two orthogonal directions within the containers, the method further comprising: calculating a packing efficiency for the optimized assignment of the layer descriptors to the subset of containers in each of the at least two orthogonal directions, the packing efficiency calculated based on a number of containers in the subset of containers and a packing efficiency of each container in the subset of containers; and loading the plurality of boxes in each container in the subset of containers according to the optimized assignment of the layer descriptors for an orthogonal direction having a packing efficiency that is greater than or equal to the packing efficiency of any other orthogonal direction. Optionally, in any of the preceding aspects, another implementation of the aspect provides the optimized assignment of the layer descriptors to a subset of containers comprises a location of each layer in its assigned container, the method further comprising creating for each container in the subset of containers an ordered list of box loading instructions, the list being ordered from first box to be loaded to last box to be loaded based on the location of each box's layer and a location and orientation of the box within the layer's optimized single-layer arrangement.

In an embodiment, the disclosure includes an apparatus comprising a memory configured to store instructions; and a processor coupled to the memory and configured to execute the instructions to: obtain characteristics of a set of containers having substantially equal dimensions; obtain characteristics of a plurality of boxes to be packed into one or more of the set of containers; create a set of layer descriptors, each layer descriptor comprising a layer thickness, identifiers of one or more boxes assigned to the layer, and a description of an arrangement of the one or more boxes assigned to the layer, each box in the plurality of boxes being assigned to a single layer description; determine an optimized assignment of the layer descriptors to containers in a subset of the set of containers; and generate an ordered list of box loading instructions for each container in the subset, the list being ordered from a first box to be loaded to a last box to be loaded based on the optimized assignment of the layer descriptors to the container, each box loading instruction comprising a box identifier, an orientation of the box, and a location of the box in the container.

Optionally, in any of the preceding aspects, another implementation of the aspect provides the processor is further configured to execute the instructions to: create a set of unassigned boxes that includes all the boxes in the plurality of boxes and, while the set of unassigned boxes is non-empty, repeatedly: create a set of CLTs having differing thicknesses based on one or more characteristics of the boxes in the set of unassigned boxes; for each CLT in the set of CLTs, determine an optimized single-layer arrangement of one or more boxes in the set of unassigned boxes in the CLT and calculate a packing efficiency for the optimized single-layer arrangement; select a CLT having a packing efficiency that is greater than or equal to the packing efficiency of any other CLT in the set of CLTs; add a layer descriptor to the set of layer descriptors, the layer descriptor comprising a thickness of the selected CLT, identifiers of the one or more boxes in the optimized single-layer arrangement for the selected CLT, and a location and orientation of each box in the optimized single-layer arrangement for the selected CLT; and remove from the set of unassigned boxes the one or more boxes in the optimized single-layer arrangement for the selected CLT.

Optionally, in any of the preceding aspects, another implementation of the aspect provides the processor is further configured to execute the instructions to determine the optimized single-layer arrangement of one or more boxes in the set of unassigned boxes in the CLT based on one or more basic constraints. Optionally, in any of the preceding aspects, another implementation of the aspect provides the processor is further configured to execute the instructions to determine the optimized single-layer arrangement of one or more boxes in the set of unassigned boxes in the CLT based additionally on one or more practical constraints relating to the boxes in the plurality of boxes. Optionally, in any of the preceding aspects, another implementation of the aspect provides the processor is further configured to execute the instructions to determine the optimized assignment of the layer descriptions to the one or more containers based on one or more practical constraints relating to the containers in the set of containers. Optionally, in any of the preceding aspects, another implementation of the aspect provides the optimized assignment of the layer descriptors to a subset of the set of containers comprises a location of each layer in its assigned container.

Optionally, in any of the preceding aspects, another implementation of the aspect provides the processor is further configured to execute the instructions to: create the set of layer descriptors and determine the optimized assignment of the layer descriptors to a subset of the set of containers for layers oriented along at least two orthogonal directions within the containers; calculate a packing efficiency for the optimized assignment of the layer descriptors to the subset of containers in each of the at least two orthogonal directions, the packing efficiency calculated based on a number of containers in the subset of containers and a packing efficiency of each container in the subset of containers; and generate the ordered list of box loading instructions for each container in the subset based on an orthogonal direction having a packing efficiency that is greater than or equal to the packing efficiency of any other orthogonal direction.

In an embodiment, the disclosure includes a non-transitory computer-readable medium storing computer instructions that when executed by one or more processors, cause the one or more processors to: obtain characteristics of a set of containers having substantially equal dimensions; obtain characteristics of a plurality of boxes to be packed into one or more of the set of containers; create a set of layer descriptors, each layer descriptor comprising a layer thickness, identifiers of one or more boxes assigned to the layer, and a description of an arrangement of the one or more boxes assigned to the layer, each box in the plurality of boxes being assigned to a single layer description; determine an optimized assignment of the layer descriptors to containers in a subset of the set of containers, the optimized assignment including a location of each layer in its assigned container; and generate an ordered list of box loading instructions for each container in the subset of containers, the list being ordered from a first box to be loaded to a last box to be loaded based on the optimized assignment of the layer descriptors to the container, each box loading instruction comprising a box identifier, an orientation of the box, and a location of the box in the container.

Optionally, in any of the preceding aspects, another implementation of the aspect provides the instructions further cause the one or more processors to: create a set of unassigned boxes that includes all the boxes in the plurality of boxes and, while the set of unassigned boxes is non-empty, repeatedly: create a set of CLTs having differing thicknesses based on one or more characteristics of the boxes in the set of unassigned boxes; for each CLT in the set of CLTs, determine an optimized single-layer arrangement of one or more boxes in the set of unassigned boxes in the CLT and calculate a packing efficiency for the optimized single-layer arrangement; select a CLT having a packing efficiency that is greater than or equal to the packing efficiency of any other CLT in the set of CLTs; add a layer descriptor to the set of layer descriptors, the layer descriptor comprising a thickness of the selected CLT, identifiers of the one or more boxes in the optimized single-layer arrangement for the selected CLT, and a location and orientation of each box in the optimized single-layer arrangement for the selected CLT; and remove the one or more boxes in the optimized single-layer arrangement from the set of unassigned boxes.

Optionally, in any of the preceding aspects, another implementation of the aspect provides the instructions further cause the one or more processors to execute the instructions to determine the optimized single-layer arrangement of one or more boxes in the set of unassigned boxes in the CLT based on one or more basic constraints. Optionally, in any of the preceding aspects, another implementation of the aspect provides the instructions further cause the one or more processors to execute the instructions to determine the optimized single-layer arrangement of one or more boxes in the set of unassigned boxes in the CLT based additionally on one or more practical constraints relating to the boxes in the plurality of boxes. Optionally, in any of the preceding aspects, another implementation of the aspect provides the instructions further cause the one or more processors to determine the optimized assignment of the layer descriptions to the one or more containers based on one or more practical constraints relating to the containers in the set of containers.

Optionally, in any of the preceding aspects, another implementation of the aspect provides the instructions further cause the one or more processors to: create the set of layer descriptors and determine the optimized assignment of the layer descriptors to a subset of the set of containers for layers oriented along at least two orthogonal directions within the containers; calculate a packing efficiency for the optimized assignment of the layer descriptors to the subset in each of the at least two orthogonal directions, the packing efficiency calculated based on a number of containers in the subset of containers and a packing efficiency of each container in the subset of containers; and generate the ordered list of box loading instructions for each container in the subset of containers based on an orthogonal direction having a packing efficiency that is greater than or equal to the packing efficiency of any other orthogonal direction.

For the purpose of clarity, any one of the foregoing embodiments may be combined with any one or more of the other foregoing embodiments to create a new embodiment within the scope of the present disclosure.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
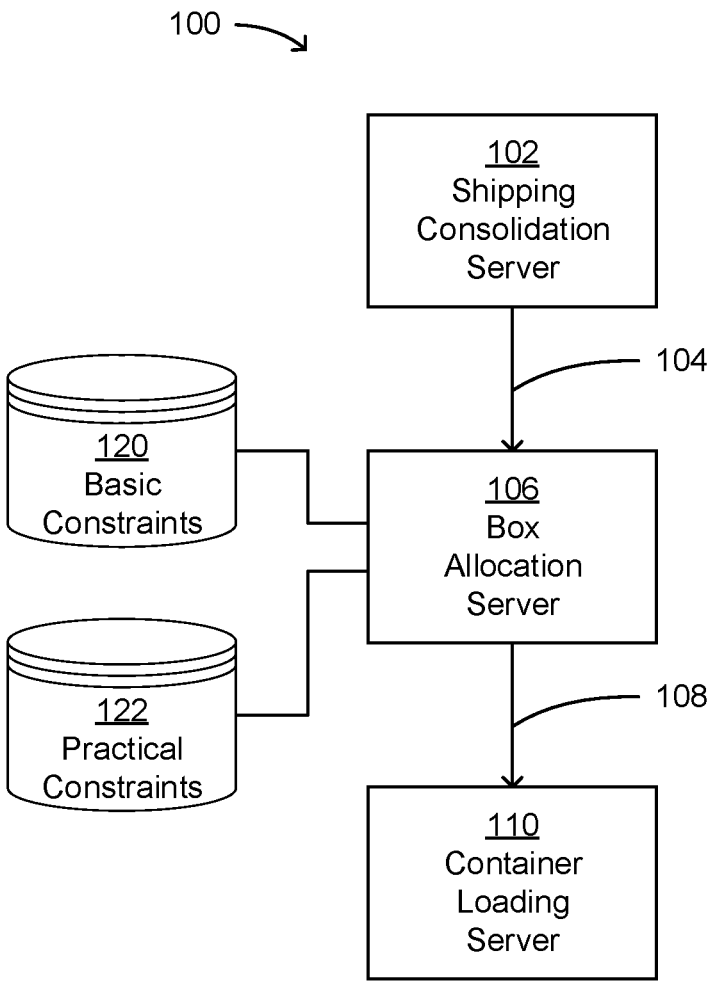
FIG. 1 is a block diagram of a system according to the disclosure.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Packing boxes into a container is one example of the three-dimensional bin packing problem (3D-BPP). Examples of 3D-BPP heuristics include the multi-dimensional knapsack approach, the mixed integer linear programming model, and methods employing branch-and-bound, finite enumeration, or genetic algorithm techniques. 3D-BPP is an important and challenging class of problem in both academia and industry (transportation, pallet/container/air cargo loading, production/scheduling). 3D-BPP is classified as a strongly nondeterministic polynomial time (NP-hard) problem. The published work for solving 3D-BPP is still limited due to the level of complexity involved. Mathematical programming (or mathematical optimization) can only solve instances with a small number of boxes to be packed, without requiring more time and/or computer power than can be allotted in commercial applications. Furthermore, the 3D-BPP solutions in most literature and even commercial software often fail to accommodate practical constraints and may yield unrealistic packing solutions.

Disclosed herein is an efficient and robust process for solving 3D-BPP, which addresses practical limitations of existing methods. A first step in the disclosed process considers a variant of 3D-BPP, where there is only a single hypothetical bin and a length of the hypothetical bin can be adjusted to accommodate the boxes packed into it. An objective of this first step is to pack all the boxes into a hypothetical bin having a minimum total length. As part of this first step, layer packing is performed to reduce the problem (single-bin 3D-BPP) to a systematic series of two-dimensional bin packing problems (2D-BPP), resulting in a set of layer descriptors.

A layer is a 'slice' through the container that is at least one box deep. Boxes with at least one dimension that is less than or equal to the depth of the layer—and which may be rotated to fit into the layer—may be packed into the layer. The 2D-BPP of packing boxes into a layer is less computationally intensive than the original 3D-BPP. Examples of 2D-BPP techniques include two-level decomposition, as well as simulated annealing, genetic algorithm, and neighborhood-and-search heuristics.

Candidate layer descriptors are evaluated for packing efficiency (or packing percentage) and candidate layers having higher packing efficiency are selected. Basic constraints and practical constraints are applied in assigning boxes to layers. Each layer descriptor identifies boxes assigned to the layer, a physical arrangement of boxes in the layer, and a thickness of the layer.

Next, a first fit decreasing (FFD) process (or other suitable process for one-dimensional bin packing problems (1D-BPP), such as those using genetic algorithms, particle swarm heuristics, or minimum bin slack heuristics) is used to assign the layer descriptors to a plurality of real-world bins (or containers) based on the thickness of each layer. Basic constraints and practical constraints are again applied in assigning boxes to containers. Finally, the boxes assigned to each container are packed into the container in an order determined by the boxes' layer and physical position in the layer, as specified in the layer descriptors assigned to the container.

Thus, the disclosed process provides a robust technique to select layer thicknesses, allowing compact packing of each layer, which increases the overall efficiency of the disclosed process. The packing solution is extended from a single-bin packing problem to a multi-bin packing problem. The multi-bin packing problem is important in practice and more difficult to solve. The optimality bound of FFD (or other 1D-BPP algorithm), allows the extension from a single-bin packing problem to a multi-bin packing problem to be accomplished with little sacrifice of overall performance.

The disclosed process also allows adaptations to accommodate basic and practical constraints of the bin packing problem. Non-limiting examples of basic constraints that may apply to boxes or containers include orthogonal packing (not packing boxes at an angle), no overlapping (boxes cannot occupy the same region of the container), and container dimension limits (boxes cannot extend outside the container when packed). Non-limiting examples of practical constraints that may apply to boxes or containers include whether boxes may be rotated (and in which directions) for packing, how high boxes may be stacked, stability limitations on box arrangement, weight limits for containers, and ensuring that the center of gravity of packed boxes is close to the center of a container for safety reasons.

FIG. 1 is a block diagram of a system 100 according to the disclosure. A shipping consolidation server 102 receives shipping orders identifying boxes and associated destinations. The shipping consolidation server 102 combines boxes having the same destination from multiple orders to produce a consolidated list 104 of boxes having a common destination. The shipping consolidation server 102 sends the consolidated list 104 to a box allocation server 106.

The box allocation server 106 applies basic constraints 120 and practical constraints 122 to the consolidated list 104 while performing a method according to the disclosure to generate a list 108 of containers with associated ordered lists of assigned boxes and their locations in the container. The box allocation server 106 sends the list 108 to a container loading server 110.

In some embodiments, the container loading server 110 prints or displays the list 108 for use by individuals loading boxes into their assigned containers. In other embodiments, the container loading server 110 formats the list 108 as required for use by mechanical systems loading the boxes into their assigned containers.

While layers are used according to the disclosure to arrange boxes in a container, the layers are only artifacts of the method. Once each box assigned to a container has been assigned a position within the container according to the position of its layer and its position within the layer, the creation of the ordered list of box loading instructions disassociates the boxes from their layers. Boxes are not necessarily loaded layer-by-layer, as in some embodiments the layers are arranged from side-to-side or bottom-to-top in the container. Instead, as ordered by the list, box loading proceeds in the conventional way from the closed end of the container to the open end.

Figure 2A:
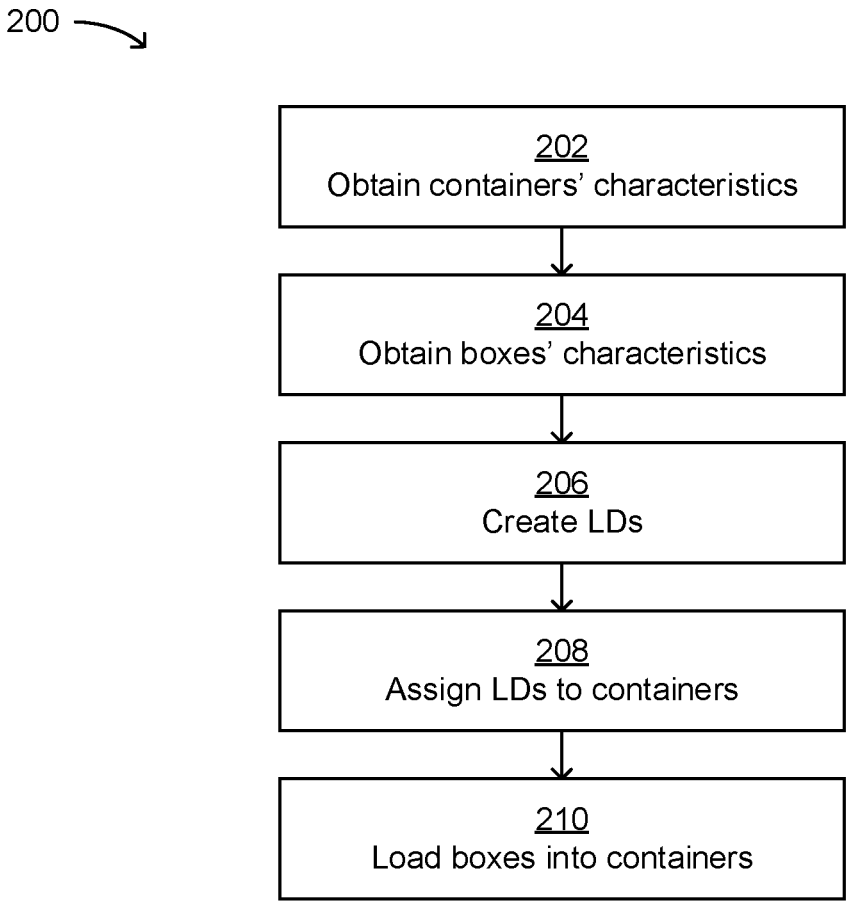
FIGS. 2A and 2B depict a flowchart of a method according to the disclosure for loading boxes in containers.
Figure 2B:
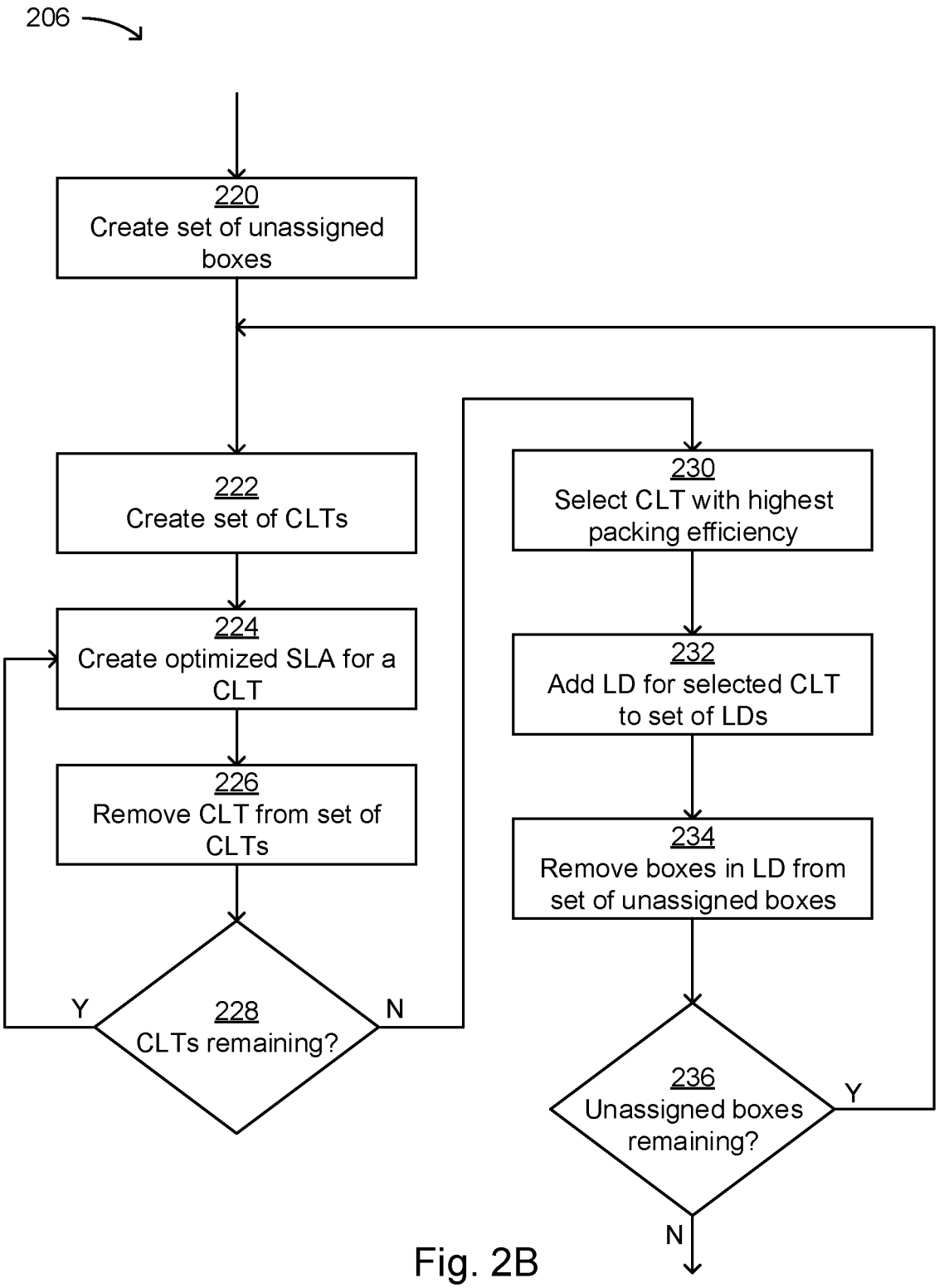

FIGS. 2A and 2B depict a flowchart of a method 200 according to the disclosure for loading boxes in containers. FIG. 2A presents steps in the method 200, while FIG. 2B presents a detailed depiction of steps taken in performing one of the steps of the method 200 of FIG. 2A.

In step 202 a system according to the disclosure obtains characteristics for a set of containers that have substantially equal dimensions. 'Substantially equal dimensions' as used herein means dimensions that are equal to within manufacturing tolerances or other tolerances used in the transportation industry. The characteristics include a number of containers in the set.

In some embodiments, the system obtains an indication that a set of industry-standard containers of a particular type are to be used. In such embodiments, the system may obtain the characteristics for containers of that type from a database of characteristics of containers of one or more types. In other embodiments, the system may receive a list specifying the characteristics for the set of containers. Non-limiting examples of the obtained characteristics include dimensions of the containers, a weight limit on goods loaded into the container, and a requirement that a center of gravity of packed goods be close to the center of the container.

In step 204, the system obtains characteristics of a plurality of boxes to be packed into one or more of the set of containers. While the present disclosure relates to boxes, it will be understood that the disclosed system and method may be used for pallets, bundles, drums, and other types of packages used for shipping. The disclosed system and method may be used for shipments comprising a mixture of different package types.

Non-limiting examples of the obtained characteristics of the boxes include dimensions of each box, weight of each box, limitations on number of such boxes that may be stacked, limitations on orientation (rotation) of each box when packed, and stability limitations (if any) on each box. Where all the boxes being packed are identical, the system may obtain a single set of characteristics applicable to all boxes in the plurality of boxes. The system may obtain a list of characteristics that includes information not used by the method according to the disclosure and extract from such a list the characteristics needed by the method.

In step 206, the system creates a set of layer descriptors (LDs), as will be explained in more detail with reference to FIG. 2B. Each LD describes a layer of boxes to be packed into a container and includes a layer thickness, identifiers of one or more boxes assigned to the layer, and a location and orientation of the one or more boxes assigned to the layer. Each box in the plurality of boxes is assigned to a single LD and the set of LDs includes all boxes in the plurality of boxes.

In step 208, the system determines an optimized assignment of the LDs to a subset of the set of containers. The assignment is optimized because it attempts to minimize the number of containers used to ship the boxes. Thus, the subset may be smaller than the set of containers. Each LD in the set of LDs is assigned to a single container and all the LDs in the set of LDs have been assigned to the subset of containers. One method of determining the optimized assignment of the LDs to the subset of containers is described in more detail with reference to FIG. 5.

Finally, in step 210, the plurality of boxes are loaded into their assigned containers in the subset of containers, according to the optimized assignment of LDs to containers. For each container in the subset, an ordered list of box loading instructions is generated. The list is ordered from a first box to be loaded into the container to a last box to be loaded into the container. The list is generated based on the location of each box's layer within the container and the location and orientation of the box within its layer's optimized single-layer arrangement.

For each box, the ordered list of box loading instructions includes a box identifier, an orientation of the box, and a location of the box in the container. The orientation of the box may be expressed as a height, width, and depth of the box, once loaded. The location of the box in the container may be expressed as an X/Y/Z position of a designated corner of the box in the container, once loaded. All box positions may be described with reference to the same designated corner: in one non-limiting example, the front most, bottom, left corner of the box, when viewed from the open end of the container.

In some embodiments, the ordered list of box loading instructions for each container is printed or displayed for the use of individuals who are physically loading the boxes into the container. In other embodiments, the ordered list of box loading instructions is transmitted to an automated system to control its mechanical loading of the boxes into the container. In still other embodiments, the ordered list is both displayed and transmitted to effect loading of the boxes with a combined human/mechanical loading system.

FIG. 2B depicts steps performed in creating a set of LDs in step 206 of method 200, described with reference to FIG. 2A. As described above, each LD describes a layer of boxes and includes a layer thickness, identifiers of one or more boxes assigned to the layer, and a description of an arrangement of the boxes in the layer. Each box in the plurality of boxes is assigned to a single LD and the set of LDs includes all boxes in the plurality of boxes.

In step 220, the system according to the disclosure creates a set of unassigned boxes. Initially, the set includes all the boxes in the plurality of boxes whose characteristics were obtained in step 204.

In steps 222-232, the method 200 creates an LD for some of the boxes in the set of unassigned boxes. As may be seen in FIG. 5, the method 200 is creating LDs in a packing direction from the closed end of a container to the open end. As such, all LDs created by the method 200 have a cross-section of the height and width of a container and whose thickness extends along the length of the container. As will be described in more detail with reference to FIG. 6, the method 200 may be used to create LDs in other packing directions within the container.

In step 222, the system creates a set of candidate layer thicknesses (CLTs) having differing thicknesses. One CLT has a thickness based on the largest dimension (height, width, or depth) of any box in the set of unassigned boxes. Another CLT has a thickness based on the smallest box dimension of any box in the set of unassigned boxes. Other CLTs have thicknesses based on intermediate dimensions of boxes in the set of unassigned boxes.

Figure 3:
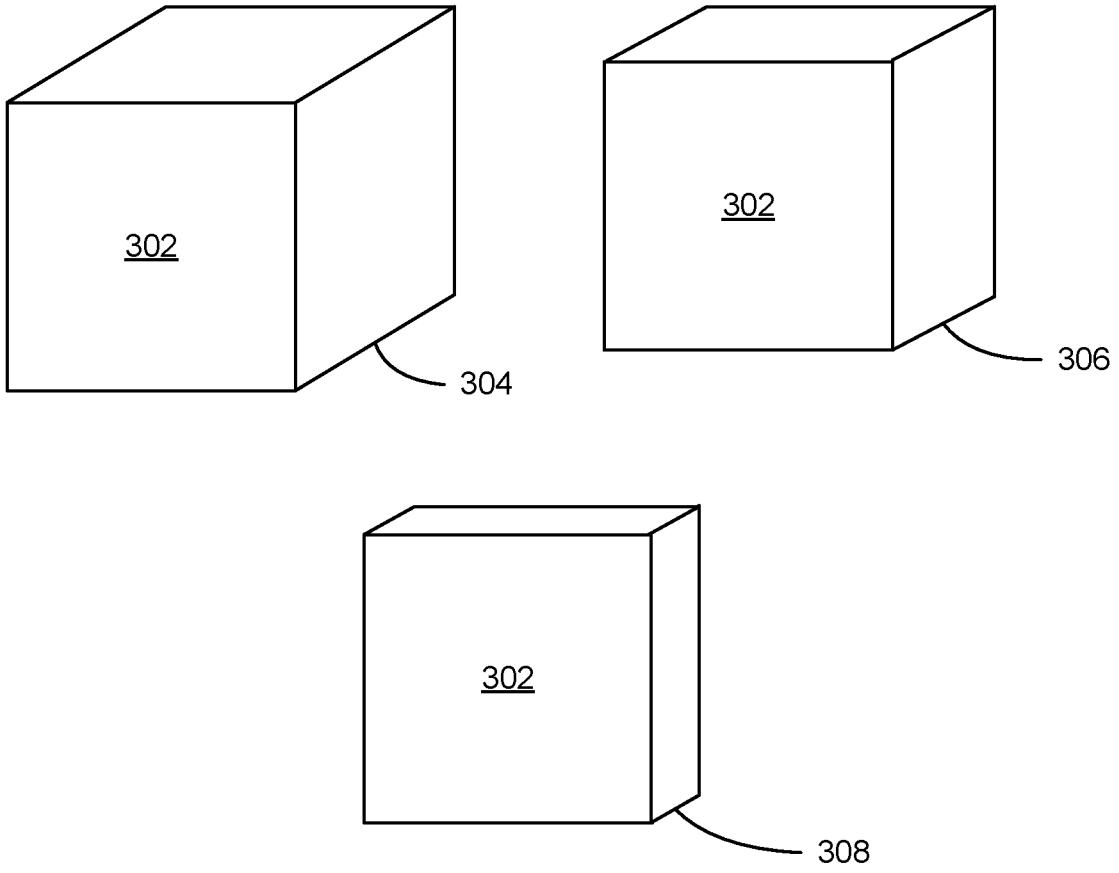
FIG. 3 depicts sample candidate layer thicknesses according to the disclosure.

FIG. 3 depicts three sample candidate layer thicknesses according to the disclosure. Cross-section 302 is a cross-section of the container being packed. Thickness 304 is the largest box dimension, thickness 306 is an intermediate box dimension, and thickness 308 is the smallest box dimension.

In step 224, an optimized single-layer arrangement (SLA) is created for one of the CLTs in the set of CLTs created in step 222 ("the current CLT"). The optimized SLA is a 2D arrangement of one or more boxes in a single layer in the current CLT. The SLA is optimized because it attempts to minimize the volume of the CLT that is not filled with boxes. That is, the optimized SLA attempts to maximize the packing efficiency of the CLT. Any suitable 2D-BPP solution may be used in step 224 to create the optimized SLA.

Figure 4:
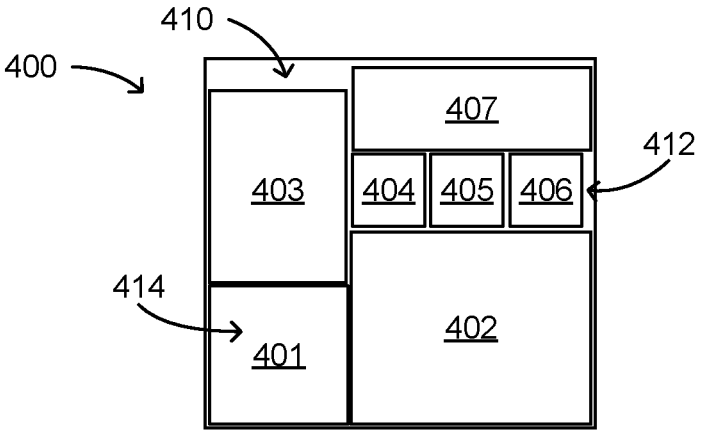
FIG. 4 depicts a sample arrangement of boxes within a layer.

FIG. 4 depicts a sample arrangement 400 of boxes 401-407 within a layer. Boxes 401 and 403 do not extend the full height of the layer, leaving empty space 410. Similarly, boxes 403-406 do not extend the full width of the container, leaving empty space 412. Finally, box 401 does not extend the full thickness of the layer, leaving empty space 414 in front of (or behind) the box 401. Nevertheless, the arrangement 400 may be the arrangement having the greatest packing efficiency and may be the optimized SLA for the current CLT.

Any optimized SLA for a CLT may be required to satisfy one or more basic constraints. In one example of a basic constraint, edges of the boxes must be perpendicular or parallel to edges of a container. In another example, boxes may not interpenetrate other boxes to occupy the same space in the CLT. In another example, boxes may not extend outside any side of the CLT.

Any optimized SLA for a CLT may also be required to satisfy one or more practical constraints. In one example, some boxes may not be rotated into certain orientations (e.g., laid on a side or turned upside down) either during packing or as finally packed. In another example, some boxes may be stacked only so high in the vertical direction. In another example, stability limitations may require that box 401 in the arrangement 400 (which does not extend the full depth of the CLT) is of a minimum thickness to permit it to support box 403 in a stable manner (e.g., not allowing box 403 to tip over during shipping).

Returning to FIG. 2B, in step 226 the current CLT for which an optimized SLA was created in step 224 is removed from the set of CLTs. In step 228, the method 200 checks whether the set of CLTs is now empty and, if there are CLTs remaining in the set of CLTs, returns to step 224 to create another optimized SLA for another CLT in the set of CLTs.

If step 228 discovers that no CLTs remain in the set of CLTs, then optimized SLAs have been created for each CLT. In step 230, the CLT having a highest packing efficiency (that is, having an associated SLA with the highest packing efficiency) is selected. Where the SLAs of several CLTs have equally high packing efficiencies, one of those CLTs may be chosen by any suitable technique. As non-limiting examples, the method 200 may select an arbitrary one of the high packing efficiency CLTs or a CLT whose SLA has the largest number of boxes.

In step 232, an LD (as described with reference to step 206 in FIG. 2A) is created for the selected CLT and SLA, and the LD is added to the set of LDs. In step 234, the boxes identified in the new LD are removed from the set of unassigned boxes that was created in step 220. In step 236, the method 200 checks whether any unassigned boxes remain. If so, the method 200 returns to step 222; if not, step 206 is complete and the method 200 moves on to assign LDs to containers in step 208 of FIG. 2A.

Figure 5:
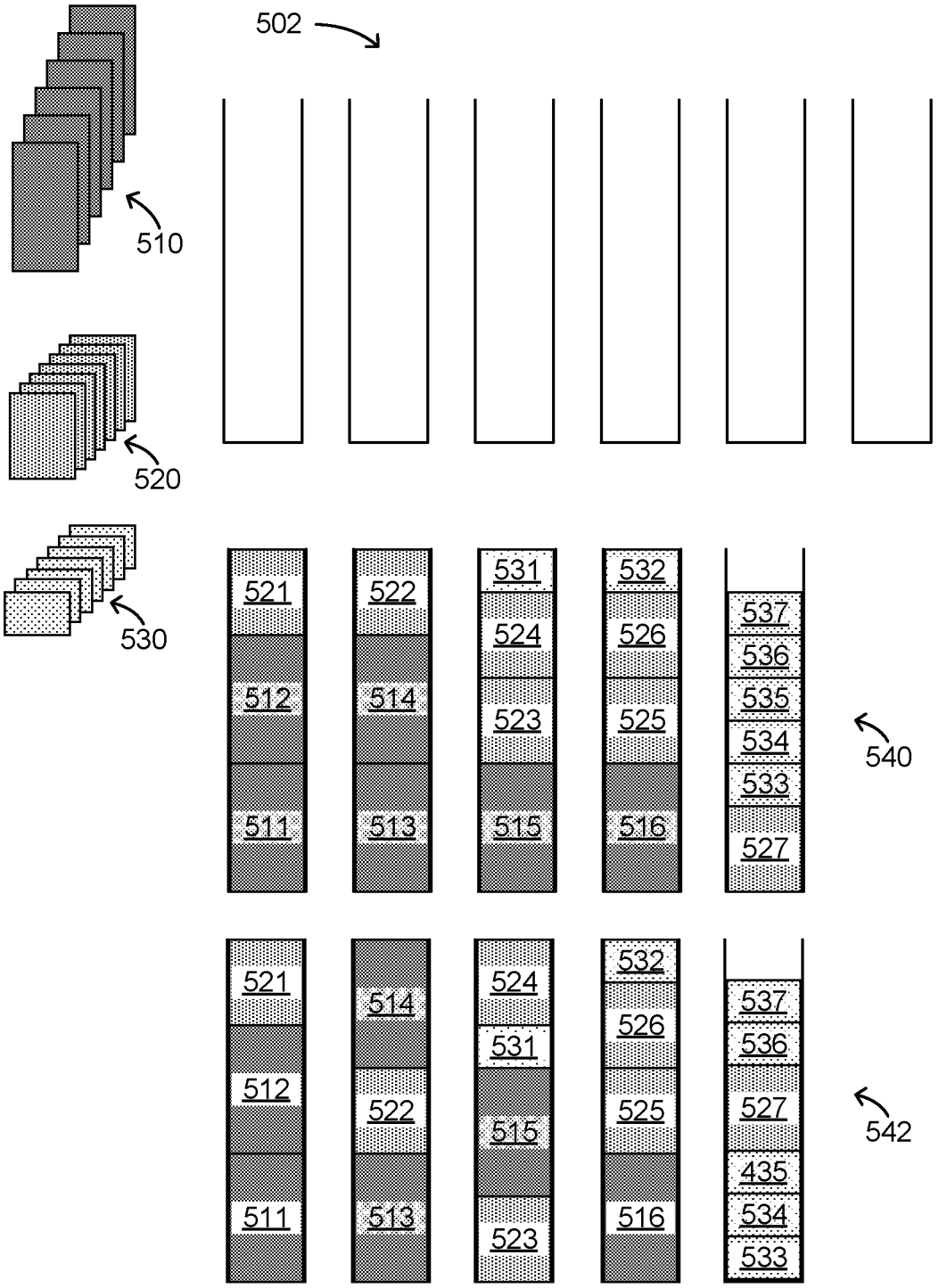
FIG. 5 depicts stages in a method according to the disclosure of assigning layers to containers.

FIG. 5 depicts stages in a method according to the disclosure of assigning layers to containers. Any suitable 1D-BPP process may be used for assigning LDs to containers in step 208 of FIG. 2A, but the current disclosure uses FFD to illustrate one possible embodiment.

Six containers 502 have been allocated to the shipping of a plurality of boxes. The performance of step 206 of FIGS. 2A and 2B has resulted in LDs 510, 520, and 530. The LDs 510 have a large layer thickness, the LDs 520 have a medium layer thickness, and the LDs 530 have a small layer thickness.

In a first stage of assigning LDs to containers 502, the FFD procedure begins by assigning each of the largest LDs (510) into the first container that they will fit in, as shown by LDs 511-515 resulting in a packing solution 540. While LD 516 would fit into the third container, the combined weight of LDs 515 and 516 would exceed the practical constraint of the container's maximum weight limit, so LD 516 has been assigned to the fourth container instead. By unmodified application of FFD, medium LDs 521-527 and small LDs 531-537 are assigned to the containers 502.

In a second stage, a further practical constraint may be applied, resulting in a rearrangement of LDs within one or more containers 502 to generate packing solution 542. In this example, the practical constraint is ensuring that the center of gravity of packed boxes is close to the center of a container. In the second container, the combined weight of boxes in LD 522 is greater than the combined weight of either LD 513 or 514, so the LDs have been rearranged to position LD 522 between LDs 513 and 514. Similarly, in the third container LD 515 has been moved closer to the center of the container, as has LD 527 in the fifth container.

Returning briefly to step 210 of FIG. 2A, the system now has information relating to a position for each layer in its container and information from the layer's LD relating to a position of each box within the layer and can generate the ordered list of box loading instructions, ordered from a first box to be loaded into the container to a last box to be loaded into the container.

The creation of LDs 510, 520, and 530 in step 206 and the assignment of LDs to containers in step 208 result in the packing solution 542 for the plurality of boxes and the set of containers obtained in steps 202 and 204, respectively. A measure of the packing efficiency of the packing solution 542 may be calculated based on a number of containers used in the packing solution (lower is better) and a packing efficiency for each container (higher is better).

An embodiment of the disclosure has been presented that assigns boxes to positions in a container using vertical layers of differing thicknesses, where the layers are arranged in a packing direction that proceeds from a closed end (back) of a container to an open end (front). Other embodiments of the disclosure may employ vertical layers where each layer extends from the back to the front of the container, i.e., layers that proceed from one side of the container to the other side. In still other embodiments, horizontal layers may be used that proceed from the bottom of the container to the top. That is, layers in a method according to the disclosure may be created in any of three orthogonal axes and in either direction in each of those axes: back to front, front to back, right to left, left to right, bottom to top, or top to bottom. Thus, there are six possible orthogonal packing directions in which to apply embodiments according to the disclosure.

Figure 6:
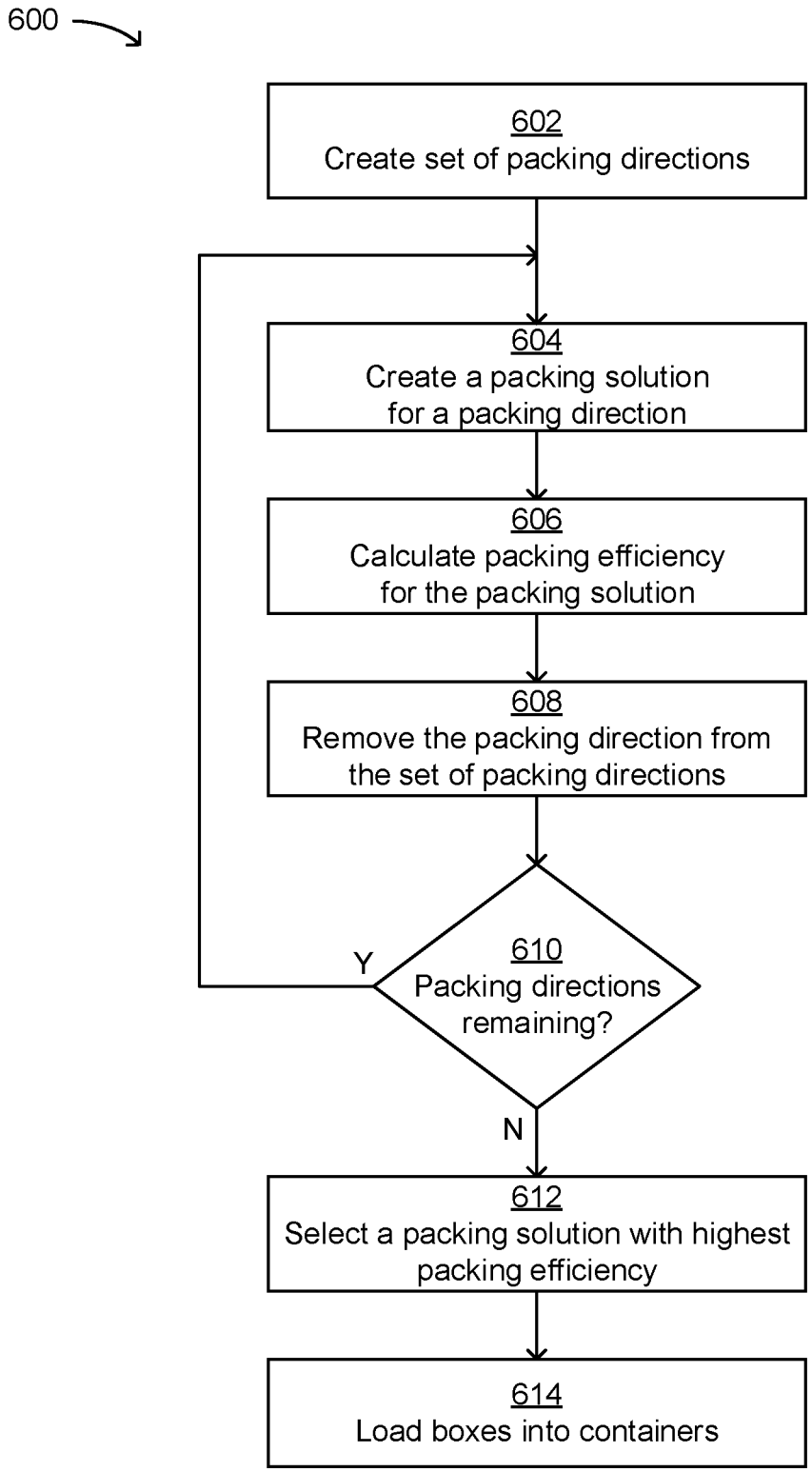
FIG. 6 depicts a flowchart of a second method according to the disclosure for loading boxes in containers.

FIG. 6 depicts a flowchart of a second method 600 according to the disclosure for loading boxes in containers.

In the method 600, layers in two or more of the six possible packing directions are created and the packing efficiencies of each direction's packing solution are compared to find a direction yielding the highest packing efficiency.

In step 602 a set of packing directions is created. The set includes two or more of the six possible packing directions. In step 604, a packing solution (the current solution) is created for one of the packing directions (the current direction), using the method 200 or another method according to the disclosure. In step 606, a packing efficiency is calculated for the current solution. As described above, the calculation of packing efficiency for a packing solution will favor solutions that use fewer containers and more fully pack each container used.

In step 608, the current direction is removed from the set of packing directions. In step 610, it is determined whether any packing directions remain in the set of packing directions. If packing directions remain, the method 600 returns to step 604.

If the set of packing directions is empty, in step 612 the method 600 selects a packing direction whose packing solution has a highest packing efficiency. If two or more packing solutions are tied for highest packing efficiency, an arbitrary one of those packing solutions may be chosen or other tie-breaking method used. Finally, in step 614, the boxes are loaded into the containers according to the selected packing solution, as described for step 210 of FIG. 2A.

Figure 7:
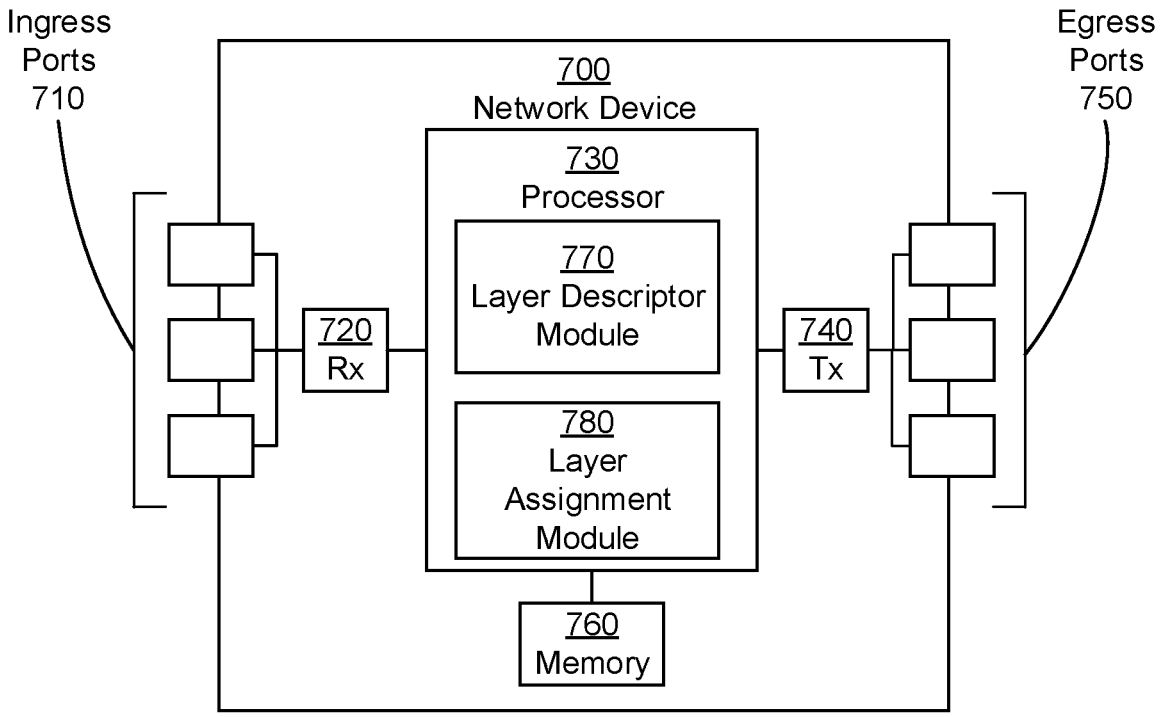
FIG. 7 shows a schematic view of an apparatus for calculating packing solutions according to an embodiment of the disclosure.

FIG. 7 is a schematic diagram of an apparatus 700 for calculating packing solutions according to an embodiment of the disclosure. The apparatus 700 is suitable for implementing the disclosed embodiments as described herein. In an embodiment, the apparatus 700 may be a network server or a stand-alone computer system. The apparatus 700 comprises ingress ports 710 and receiver units (Rx) 720 for receiving data; a processor, logic unit, or central processing unit (CPU) 730 to process the data; transmitter units (Tx) 740 and egress ports 750 for transmitting the data; and a memory 760 for storing the data. The apparatus 700 may also comprise optical-to-electrical (OE) components and electrical-to-optical (EO) components coupled to the ingress ports 710, the receiver units 720, the transmitter units 740, and/or the egress ports 750 for egress or ingress of optical or electrical signals.

The processor 730 is implemented by hardware and software. The processor 730 may be implemented as one or more CPU chips, cores (e.g., as a multi-core processor), field-programmable gate arrays (FPGAs), application specific integrated circuits (ASICs), and digital signal processors (DSPs). The processor 730 is in communication with the ingress ports 710, the receiver units 720, the transmitter units 740, the egress ports 750, and the memory 760. The processor 730 comprises a layer descriptor module (LDM) 770 and a layer assignment module (LAM) 780. The LDM 770 and LAM 780 implement the disclosed embodiments described herein. For instance, the LDM 770 configures the processor 730 to create a set of layer descriptors and the LAM 780 configures the processor 730 to assign layer descriptors to containers. The inclusion of the LDM 770 and the LAM 780 therefore provide a substantial improvement to the functionality of the apparatus 700 and effect an unconventional technological solution to the NP-hard technological problem of 3-dimensional bin packing. Alternatively, the LDM 770 and LAM 780 are implemented as instructions stored in the memory 760 and executed by the processor 730.

The memory 760 comprises one or more disks, tape drives, and solid-state drives and may be used as an overflow data storage device, to store programs when such programs are selected for execution, and to store instructions and data that are read during program execution. The memory 760 may be volatile and/or non-volatile and may be read-only memory (ROM), random access memory (RAM), ternary content-addressable memory (TCAM), and/or static random-access memory (SRAM).

A method for loading boxes in containers including means for obtaining characteristics of a set of containers having substantially equal dimensions; means for obtaining characteristics of a plurality of boxes to be packed into one or more of the set of containers; means for creating a set of layer descriptors, each layer descriptor comprising a layer thickness, identifiers of one or more boxes assigned to the layer, and a description of an arrangement of the one or more boxes assigned to the layer, each box in the plurality of boxes being assigned to a single layer description; means for determining an optimized assignment of the layer descriptors to containers in a subset of the set of containers; and means for loading the plurality of boxes in each container in the subset according to the optimized assignment of the layer descriptors for the container.

An apparatus including memory means configured to store instructions; a processing means coupled to the memory means, the processor means configured to execute the instructions stored in the memory means to obtain characteristics of a set of containers having substantially equal dimensions; obtain characteristics of a plurality of boxes to be packed into one or more of the set of containers; create a set of layer descriptors, each layer descriptor comprising a layer thickness, identifiers of one or more boxes assigned to the layer, and a description of an arrangement of the one or more boxes assigned to the layer, each box in the plurality of boxes being assigned to a single layer description; determine an optimized assignment of the layer descriptors to containers in a subset of the set of containers; and generate an ordered list of box loading instructions for each container in the subset, the list being ordered from a first box to be loaded to a last box to be loaded based on the optimized assignment of the layer descriptors to the container, each box loading instruction comprising a box identifier, an orientation of the box, and a location of the box in the container.

A non-transitory computer-readable means for storing computer instructions that when executed by one or more processing means, cause the one or more processing means to obtain characteristics of a set of containers having substantially equal dimensions; obtain characteristics of a plurality of boxes to be packed into one or more of the set of containers; create a set of layer descriptors, each layer descriptor comprising a layer thickness, identifiers of one or more boxes assigned to the layer, and a description of an arrangement of the one or more boxes assigned to the layer, each box in the plurality of boxes being assigned to a single layer description; determine an optimized assignment of the layer descriptors to containers in a subset of the set of containers, the optimized assignment including a location of each layer in its assigned container; and generate an ordered list of box loading instructions for each container in the subset of containers, the list being ordered from a first box to be loaded to a last box to be loaded based on the optimized assignment of the layer descriptors to the container, each box loading instruction comprising a box identifier, an orientation of the box, and a location of the box in the container.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled may be directly or indirectly coupled or communicating with each other, may be directly or indirectly communicating through some interface, device, or intermediate component whether electrically, mechanically, or otherwise. Where a first element is shown or described as occurring in response to a second element, the first element may occur in direct response or in indirect response to the second element. Other examples of changes, substitutions, and alterations are ascertainable by one skilled in the art and could be made without departing from the spirit and scope disclosed herein.

What is claimed is:

1. An apparatus, comprising:

a memory configured to store instructions; and a processor coupled to the memory and configured to execute the instructions to:

obtain characteristics of a plurality of containers having substantially equal dimensions;

obtain characteristics of a plurality of boxes to be packed into one or more containers of the plurality of containers;

create a plurality of layer descriptors, each layer descriptor comprising a layer thickness, the layer thickness being less than a dimension of the containers of the plurality of containers, comprising identifiers of one or more boxes assigned to a layer, and comprising a description of an arrangement of the one or more boxes assigned to the layer, each box in the plurality of boxes being assigned to a single layer descriptor;

determine an optimized assignment of the layer descriptors to containers in a subset of the plurality of containers; and generate an ordered list of box loading instructions for each container in the subset, the ordered list being ordered from a first box to be loaded to a last box to be loaded based on the optimized assignment of the layer descriptors to the container, each box loading instruction comprising a box identifier, an orientation of the box, and a location of the box in the container.

2. The apparatus of claim 1, wherein the processor is further configured to execute the instructions to:

create a set of unassigned boxes that includes all the boxes in the plurality of boxes and, while the set of unassigned boxes is non-empty, repeatedly:

create a set of candidate layer thicknesses (CLTs) having differing thicknesses based on one or more characteristics of the boxes in the set of unassigned boxes;

for each CLT in the set of CLTs, determine an optimized single-layer arrangement of one or more boxes in the set of unassigned boxes in the CLT and calculate a packing efficiency for the optimized single-layer arrangement;

select a CLT having a packing efficiency that is greater than or equal to the packing efficiency of any other CLT in the set of CLTs;

add a layer descriptor to the plurality of layer descriptors, the layer descriptor comprising a thickness of the selected CLT, identifiers of the one or more boxes in the optimized single-layer arrangement for the selected CLT, and a location and orientation of each box in the optimized single-layer arrangement for the selected CLT; and remove from the set of unassigned boxes the one or more boxes in the optimized single-layer arrangement for the selected CLT.

3. The apparatus of claim 2, wherein the processor is further configured to execute the instructions to determine the optimized single-layer arrangement of the one or more boxes in the set of unassigned boxes in the CLT based on one or more basic constraints.

4. The apparatus of claim 3, wherein the processor is further configured to execute the instructions to determine the optimized single-layer arrangement of the one or more boxes in the set of unassigned boxes in the CLT based additionally on one or more practical constraints relating to the boxes in the plurality of boxes.

5. The apparatus of claim 1, wherein the processor is further configured to execute the instructions to determine the optimized assignment of the layer descriptors to the plurality of containers based on one or more practical constraints relating to the plurality of containers.

6. The apparatus of claim 5, wherein the optimized assignment of the layer descriptors to a subset of the plurality of containers comprises a location of each layer in its assigned container.

7. The apparatus of claim 1, wherein the processor is further configured to execute the instructions to:

create the plurality of layer descriptors and determine the optimized assignment of the layer descriptors to a subset of the plurality of containers for layers oriented along at least two orthogonal directions within the containers;

calculate a packing efficiency for the optimized assignment of the layer descriptors to containers in the subset of the plurality of containers in each of the at least two orthogonal directions, the packing efficiency calculated based on a number of containers in the subset of the plurality of containers and a packing efficiency of each container in the subset of the plurality of containers; and generate the ordered list of box loading instructions for each container in the subset of the plurality of containers based on an orthogonal direction having a packing efficiency that is greater than or equal to the packing efficiency of any other orthogonal direction.

8. A non-transitory computer-readable medium storing computer instructions that when executed by one or more processors, cause the one or more processors to:

obtain characteristics of a plurality of containers having substantially equal dimensions;

obtain characteristics of a plurality of boxes to be packed into one or more containers of the plurality of containers;

create a plurality of layer descriptors, each layer descriptor comprising a layer thickness, the layer thickness being less than a dimension of the containers of the plurality of containers, comprising identifiers of one or more boxes assigned to a layer, and comprising a description of an arrangement of the one or more boxes assigned to the layer, each box in the plurality of boxes being assigned to a single layer descriptor;

determine an optimized assignment of the layer descriptors to containers in a subset of the plurality of containers, the optimized assignment including a location of each layer in its assigned container; and generate an ordered list of box loading instructions for each container in the subset of the plurality of containers, the ordered list being ordered from a first box to be loaded to a last box to be loaded based on the optimized assignment of the layer descriptors to the container, each box loading instruction comprising a box identifier, an orientation of the box, and a location of the box in the container.

9. The non-transitory computer-readable medium of claim 8, wherein the computer instructions further cause the one or more processors to:

create a set of unassigned boxes that includes all the boxes in the plurality of boxes and, while the set of unassigned boxes is non-empty, repeatedly:

create a set of candidate layer thicknesses (CLTs) having differing thicknesses based on one or more characteristics of the boxes in the set of unassigned boxes;

for each CLT in the set of CLTs, determine an optimized single-layer arrangement of one or more boxes in the set of unassigned boxes in the CLT and calculate a packing efficiency for the optimized single-layer arrangement;

select a CLT having a packing efficiency that is greater than or equal to the packing efficiency of any other CLT in the set of CLTs;

add a layer descriptor to the plurality of layer descriptors, the layer descriptor comprising a thickness of the selected CLT, identifiers of the one or more boxes in the optimized single-layer arrangement for the selected CLT, and a location and orientation of each box in the optimized single-layer arrangement for the selected CLT; and remove from the set of unassigned boxes the one or more boxes in the optimized single-layer arrangement for the selected CLT.

10. The non-transitory computer-readable medium of claim 9, wherein the computer instructions further cause the one or more processors to execute the instructions to determine the optimized single-layer arrangement of the one or more boxes in the set of unassigned boxes in the CLT based on one or more basic constraints.

11. The non-transitory computer-readable medium of claim 10, wherein the computer instructions further cause the one or more processors to execute the instructions to determine the optimized single-layer arrangement of the one or more boxes in the set of unassigned boxes in the CLT based additionally on one or more practical constraints relating to the boxes in the plurality of boxes.

12. The non-transitory computer-readable medium of claim 8, wherein the computer instructions further cause the one or more processors to determine the optimized assignment of the layer descriptors to the plurality of containers based on one or more practical constraints relating to the plurality of containers.

13. The non-transitory computer-readable medium of claim 8, wherein the computer instructions further cause the one or more processors to:

create the plurality of layer descriptors and determine the optimized assignment of the layer descriptors to a subset of the plurality of containers for layers oriented along at least two orthogonal directions within the containers;

calculate a packing efficiency for the optimized assignment of the layer descriptors to the containers in the subset of the plurality of containers in each of the at least two orthogonal directions, the packing efficiency calculated based on a number of containers in the subset of the plurality of containers and a packing efficiency of each container in the subset of the plurality of containers; and generate the ordered list of box loading instructions for each container in the subset of the plurality of containers based on an orthogonal direction having a packing efficiency that is greater than or equal to the packing efficiency of any other orthogonal direction.

* * * * *